US009161143B2

(12) United States Patent
Tan

(10) Patent No.: US 9,161,143 B2
(45) Date of Patent: Oct. 13, 2015

(54) BTE HEARING INSTRUMENT WITH HOUSING AND SOUND TUBE

(71) Applicant: SIVANTOS PTE. LTD, Singapore (SG)

(72) Inventor: Beng Hai Tan, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/600,408

(22) Filed: Jan. 20, 2015

(65) Prior Publication Data

US 2015/0208182 A1 Jul. 23, 2015

(30) Foreign Application Priority Data

Jan. 20, 2014 (DE) ..... 10 2014 200 917

(51) Int. Cl.
*H04R 25/00* (2006.01)

(52) U.S. Cl.
CPC ..... *H04R 25/65* (2013.01); *H04R 25/554* (2013.01); *H04R 25/60* (2013.01); *H04R 2225/021* (2013.01); *H04R 2225/63* (2013.01)

(58) Field of Classification Search
CPC .... H04R 1/1016; H04R 1/105; H04R 25/554; H04R 25/60; H04R 25/604; H04R 25/65; H04R 25/658; H04R 2225/021; H04R 2225/025; H04R 2225/63
USPC ..... 381/322, 324, 327, 328, 330, 380, 381, 381/382; 181/128, 129
See application file for complete search history.

(56) References Cited

U.S. PATENT DOCUMENTS

| | | | | |
|---|---|---|---|---|
| 6,700,983 | B1 * | 3/2004 | Bøgeskov-Jensen et al. | 381/322 |
| 7,142,926 | B2 | 11/2006 | Crawford | |
| 7,599,508 | B1 | 10/2009 | Lynch et al. | |
| 7,715,580 | B2 * | 5/2010 | Nielsen | 381/322 |
| 8,170,253 | B1 | 5/2012 | Lynch et al. | |
| 8,591,239 | B2 | 11/2013 | Dai et al. | |
| 8,755,551 | B2 * | 6/2014 | Ritter et al. | 381/330 |
| 2006/0171549 | A1 | 8/2006 | Holmes | |
| 2006/0171550 | A1 | 8/2006 | Bryant et al. | |
| 2011/0022121 | A1 | 1/2011 | Meskins | |
| 2013/0004005 | A1 | 1/2013 | Barth et al. | |

FOREIGN PATENT DOCUMENTS

| | | |
|---|---|---|
| DK | 1487237 T3 | 6/2009 |
| EP | 1487237 A1 | 12/2004 |

(Continued)

*Primary Examiner* — Huyen D Le
(74) *Attorney, Agent, or Firm* — Laurence A. Greenberg; Werner H. Stemer; Ralph E. Locher

(57) ABSTRACT

A behind the ear (BTE) hearing instrument has a coupling between a housing and a sound tube. The sound tube is removably connected to the housing by a coupling connected to the sound tube. A sound-tube-side coupling component has a sound channel leading to the sound tube and a housing-side coupling component has a sound channel leading to a receiver, which, when the coupling is closed, are connected to each other by an acoustic seal. The coupling has a lug and an abutment, which connect the sound-tube-side coupling component to the housing-side coupling component in a form-fit and movable manner, in a spatial direction relative to each other. A locking device is provided that, when it is closed, impedes a movement of the coupling components relative to each other. The lug including the corresponding abutment and the locking device are disposed spatially separated from each other in the coupling.

7 Claims, 4 Drawing Sheets

(56) References Cited

FOREIGN PATENT DOCUMENTS

| | | | |
|---|---|---|---|
| EP | 1816893 | A1 | 8/2007 |
| EP | 2560411 | A2 | 2/2013 |
| WO | 2009117778 | A1 | 10/2009 |
| WO | 2010129568 | A1 | 11/2010 |

* cited by examiner

BTE HEARING INSTRUMENT WITH HOUSING AND SOUND TUBE

CROSS-REFERENCE TO RELATED APPLICATION

This application claims the priority, under 35 U.S.C. §119, of German application DE 10 2014 200 917.0, filed Jan. 20, 2014; the prior application is herewith incorporated by reference in its entirety.

BACKGROUND OF THE INVENTION

Field of the Invention

The invention relates to a hearing instrument to be worn behind the ear (BTE) having a coupling between a housing and a sound tube, and a housing and a sound tube of such a hearing instrument.

Hearing instruments can be embodied for instance as hearing devices. A hearing device is used to supply a hearing-impaired person with acoustic ambient signals which are processed and amplified in order to compensate for or treat the respective hearing impairment. It consists, in principle, of one or a number of input transducers, a signal processing facility, an amplifier and an output transducer. The input transducer is generally a sound receiver, e.g. a microphone, and/or an electromagnetic receiver, e.g. an induction coil. The output transducer is usually implemented as an electroacoustic converter, e.g. a miniature loudspeaker, or as an electromechanical converter, e.g. a bone conduction earpiece. It is also referred to as an earpiece or receiver. The output transducer generates output signals, which are routed to the ear of the patient and are to generate a hearing perception in the patient. The amplifier is generally integrated in the signal processing facility. Power is supplied to the hearing device by a battery integrated in the hearing device housing. The main components of a hearing device are generally arranged on a printed circuit board as a circuit substrate or connected thereto.

Besides hearing devices, hearing instruments can also be embodied as so-called tinnitus maskers. Tinnitus maskers are used to treat tinnitus patients. They generate acoustic output signals dependent on the respective hearing impairment and, depending on the working principle, also on ambient noises, the output signals possibly contributing to reducing the perception of interfering tinnitus or other ear noises.

Furthermore, hearing instruments can also be embodied as telephones, cell phones, headsets, earphones, MP3 players or other electronic telecommunication or entertainment systems.

The term hearing instrument is to be understood below both as hearing devices, and also tinnitus maskers, comparable devices of such type as well as electronic telecommunication and entertainment systems.

Hearing instruments, in particular hearing devices, are known in various basic types. With in-the-ear (ITE) hearing devices, a housing containing all functional components including a microphone and a receiver is worn at least partially in the auditory canal. Completely-in-canal (CIC) hearing devices are similar to ITE hearing devices, but are worn entirely in the auditory canal. With behind the ear (BTE) hearing devices, a housing with components such as a battery and a signal processing facility is worn behind the ear and a flexible sound tube, also referred to as a tube, routes the acoustic output signals of a receiver from the housing to the auditory canal, where an earpiece on the tube is frequently provided to reliably position the tube end in the auditory canal. Receiver in canal, behind the ear (RIC-BTE) hearing devices are similar to BTE hearing devices, but the receiver is worn in the auditory canal and instead of a sound tube, a flexible receiver tube routes electrical signals, instead of acoustic signals, to the receiver, which is attached to the front of the receiver tube, in most instances in an earpiece used for reliable positioning within the auditory canal. RIC-BTE hearing devices are frequently used as so-called open-fit devices, in which the auditory canal remains open for the passage of sound and air in order to reduce the interfering occlusion effect.

It is common to all hearing device types that the smallest possible housing or designs are sought in order to increase wearing comfort, if applicable to improve the implantability and if applicable to reduce the visibility of the hearing device for cosmetic reasons. The smallest possible design is also sought for most other hearing instruments.

It is known how to assemble BTE hearing instruments from a housing to be worn behind the ear and a receiver tube for connecting a receiver (with RIC-BTE hearing instruments) or a sound tube as an acoustic signal line (with BTE hearing instruments). The tube and housing can be connected removably to each other for example by a screw-in, snap-in or plug-in coupling. On the one hand, the coupling must be mechanically sufficiently stable so as not to be removed unintentionally during everyday use. On the other hand, the coupling should not impair wearing comfort and should be visually inconspicuous. A sufficiently easy removability of the coupling for maintenance and adjustment purposes is frequently also desired. With BTE hearing instruments the sound tube must additionally be connected in a soundproof manner, in other words the coupling must be soundproof.

A RIC-BTE hearing instrument, in which an earpiece tube is connected to a BTE housing by a plug-in connector, is known from the publication U.S. patent publication No. 2013/0004005 A1. The plug-in connector is disposed on an underside of the BTE housing. It can be locked with a pin or by an elastic snap-in catch. A sound tube is not provided on this hearing instrument and consequently the plug connector is not configured so as to be acoustically sealed.

A BTE hearing instrument, in which a sound tube is connected to a wearing hook of the hearing instrument, is known from the publication European patent application EP 1 487 237 A1. By use of a flange, a thickening or a threaded tube on the wearing hook, over which the sound tube is sheathed, the connection is configured so as to be mechanically stable and acoustically sealed.

A BTE hearing instrument, in which a sound tube is connected to a front side of the BTE housing by a plug, is known from the publication U.S. patent publication No. 2006/0171550 A1.

SUMMARY OF THE INVENTION

The object underlying the invention is to disclose a coupling that is slimline, easy-to-use and low-cost in installation, for the sound-insulated connection of sound tube and housing of a BTE hearing instrument.

The invention achieves this object by a hearing instrument and a housing and a sound tube with a corresponding coupling having the features of the independent claims.

A basic idea of the invention consists in a BTE hearing instrument containing a housing and a sound tube that is removably connected to the housing by a coupling connected to the sound tube in a sound-insulated manner. The coupling has a lug and an abutment corresponding to the lug and an additional locking device. A sound-tube-side coupling component has a sound channel leading to the sound tube and a housing-side coupling component has a sound channel leading to a receiver, which, when the coupling is closed, are connected to each other in an insulated manner by an acoustic seal. The lug including the corresponding abutment connect the sound-tube-side coupling component to the housing-side coupling component in a form-fit and movable manner, in at least one spatial direction relative to each other. The additional locking device, when it is closed, impedes a movement of the coupling components relative to each other in the at least one spatial direction. The lug including the corresponding abutment on the one hand, and locking device on the other hand, are disposed spatially separated from each other in the coupling.

Through the combination of a form-fit connection on the one hand with a locking device on the other hand, a particularly simple closing of the coupling is made possible. It is of no concern here whether the lug is on the housing-side coupling component and the abutment on the sound-tube-side coupling component or vice versa. It is important merely that a connection is created thereby that is on the one hand form-fit, but is on the other hand removable. The additional locking device can be embodied in a conventional manner, for example with a slider, a connecting pin or a screw connection. It serves to lock the connection overall, as it inhibits the residual movement in the form-fit connection. In other words, when closing the coupling, the form-fit connection is first created and then locked in place by the locking device. The housing-side coupling component is thus formed by the housing-side sound-channel seal and by the housing-side part of the locking device and, depending on the arrangement, the lug or the corresponding abutment.

An advantageous further development of the basic idea consists in the seal containing an elastic component that, when the coupling is closed, is compressed so that it causes an elastic force in the opening direction of the coupling components relative to each other, and so that the additional locking device counteracts the elastic force such that an opening of the coupling is impeded. Thus in a simple, uncomplicated manner a blocking effect is achieved so that the additional locking device in turn does not need to be of a self-locking design.

A further advantageous development of the basic idea consists in the coupling containing an additional snap-in locking device that snaps in when the coupling is closed. The additional snap-in locking device on the one hand provides the coupling with additional protection against unintentional and undesired opening. On the other hand, snapping-in the snap-in locking device can cause a provisional closing of the coupling before the final closing is affected by the additional locking device. Here the provisional snap-in locking device facilitates closing of the additional locking device or handling while closing.

A further advantageous development of the basic idea consists in the additional snap-in locking device being disposed spatially closer in the coupling to the additional locking device than to the lug including corresponding abutment. The spatially distanced arrangement results in a mechanically stable arrangement that is not prone to buckling or twisting. It also makes handling easier as the coupling is first closed provisionally on the side by lug and abutment and then, once already provisionally fixed, is finally locked on the other side. By virtue of the form-fit connection, the provisionally-fixed coupling has less freedom of movement and is therefore easy to hold.

A further advantageous development of the basic idea consists in the additional locking device contains a hole and a corresponding locking pin. This provides for a particularly simple yet also reliable locking device that has been tested in handling.

A further basic idea of the invention consists in a sound tube for a BTE hearing instrument that is embodied as described above, which can be removably connected to the housing by a coupling connected to the sound tube in a sound-insulated manner. The coupling has a lug and an abutment corresponding to the lug and an additional locking device. The sound-tube-side coupling component has a sound channel leading to the sound tube. The lug including the corresponding abutment can connect the sound-tube-side coupling component to the housing-side coupling component in a form-fit and movable, in at least one spatial direction relative to each other. The additional locking device, when it is closed, impedes a movement of the coupling components relative to each other in the at least one spatial direction. The lug including corresponding abutment on the one hand, and the locking device on the other hand, are disposed spatially separated from each other in the coupling.

A further basic idea of the invention consists in a housing for a BTE hearing instrument that is realized as described above, which can be removably connected thereto by a coupling connected to the sound tube in a sound-insulated manner. The coupling has a lug and an abutment corresponding to the lug and an additional locking device, wherein the housing-side coupling component has a sound channel leading to a receiver. The lug including corresponding abutment can connect the sound-tube-side coupling component to the housing-side coupling component in a form-fit and movable, in at least one spatial direction relative to each other. The additional locking device, when it is closed, impedes a movement of the coupling components relative to each other in the at least one spatial direction. The lug including the corresponding abutment on the one hand, and locking device on the other hand, are disposed spatially separated from each other in the coupling.

Other features which are considered as characteristic for the invention are set forth in the appended claims.

Although the invention is illustrated and described herein as embodied in a BTE hearing instrument with a housing and a sound tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
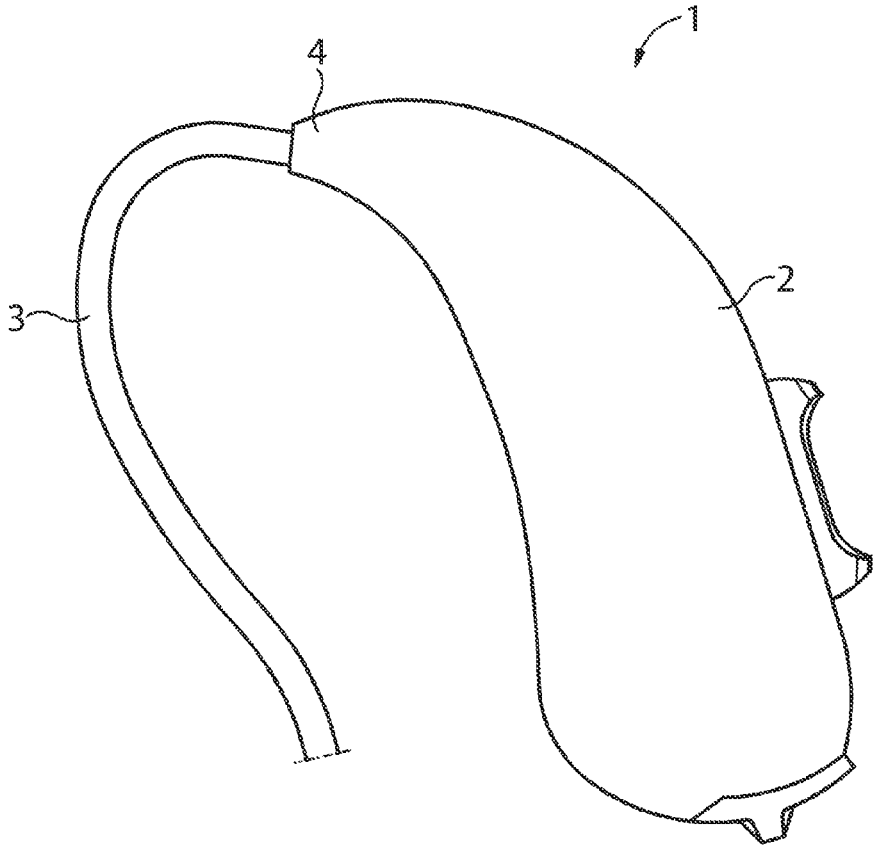
FIG. 1 is an illustration of a BTE hearing instrument with a sound tube and a coupling according to the invention.

Referring now to the figures of the drawings in detail and first, particularly to FIG. 1 thereof, there is shown a schematic view of a BTE hearing instrument 1 including a sound tube 3 and a coupling. The sound tube 3 is connected to a housing 2 by way of a sound-tube-side coupling component 4. The coupling is closed.

Figure 2:
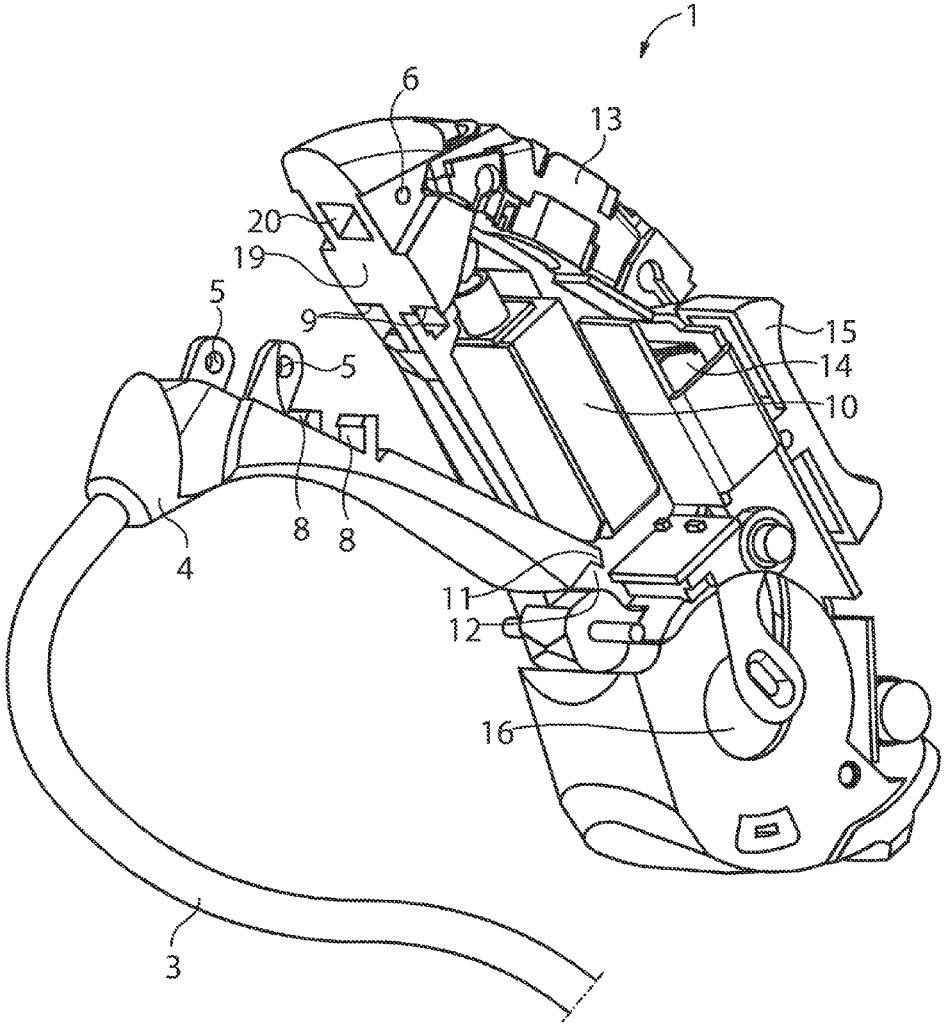
FIG. 2 is a diagrammatic, perspective view of the BTE hearing instrument with an open coupling.

FIG. 2 shows a perspective view of the BTE hearing instrument without housing and with open coupling. The basic components of a hearing instrument are identifiable in the interior of the BTE housing. A battery 16 serves to supply energy, a signal processing facility 14 serves to process and amplify signals from a microphone arrangement 13, and a receiver 10 converts the signals from the signal processing facility 14 into acoustic signals. A rocker switch 15 is also shown that can serve for example to change the volume or the currently active listening program.

The acoustic signals that the receiver 10 generates are routed by way of a tube (not shown in the figure) to a housing-side sound channel 20. The acoustic signals leave the housing via the housing-side sound channel 20. Disposed around the housing-side sound channel 20 or its output opening is a sealing surface 19 that provides for a sound-insulated connection of a sound-tube-side sound channel.

Connected to the sound tube 3 is the sound-tube-side coupling component 4. This contains two holes 5 that can be made to overlap with the hole 6 of the housing in which the coupling is enclosed. Two snap-in catches 8 are also identifiable that snap into the snap-in catch receivers 9 when the coupling is closed. This provides a snap-in locking measure for the coupling. Finally two lugs 11 are disposed at the end of the sound-tube-side coupling component 4 that is shown on the right in the figure, which are mutually engaged with two abutments 12 on the housing.

In the figure just one lug 11 and one abutment 12 respectively are identifiable.

The sound-tube-side coupling component 4 is inserted into the corresponding abutments 12 with the lugs 11. This can be achieved by moving down and to the right (with reference to the figure) the sound-tube-side coupling component 4. Conversely it can be released from the abutments 12 by an opposite movement. When the lugs 11 are inserted into the abutments 12, a form-fit connection is created between these that impedes a movement away from the housing, in other words down and to the left (with reference to the figure). As shown, however, a rotation or pivoting of the sound-tube-side coupling component 4 about the form-fit connection of the lugs 11 and corresponding abutments 12 is possible. In other words, to close the coupling the sound-tube-side coupling component 4 can first be inserted into the abutments 12 in order then to be mounted or pivoted about the abutments 12 on to the housing. During mounting on the housing, the snap-in locking device, which is formed by the snap-in catches 8 and the snap-in catch receivers 9, snaps in.

In the closed position of the coupling, the holes 5 overlap with the hole 6 or are aligned with each other. A locking pin can then be pushed through the holes 5, 6 as an additional locking device to finally lock the coupling.

Figure 3:
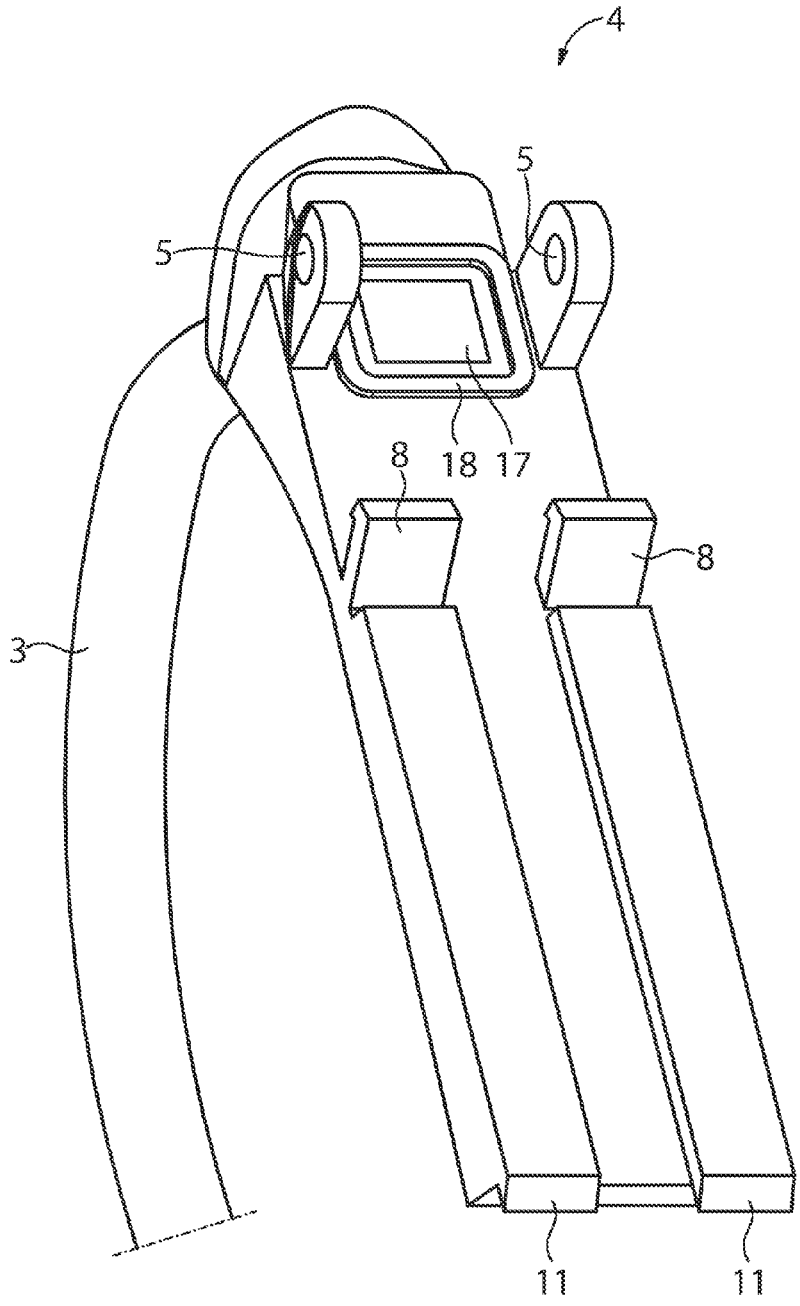
FIG. 3 is a perspective view of a sound-tube-side coupling component.

FIG. 3 shows a perspective view of the sound-tube-side coupling component 4, which is connected to the sound tube 3 in a sound-insulated manner. The sound-tube-side sound channel 17 leads, through the coupling component 4, into the interior of the sound-tube 3. An elastic seal 18 is disposed around the opening of the sound channel 17. This can be embodied for example as a conventional sealing ring or attached in a conventional dual-component assembly. When the sound-tube-side coupling component 4 is connected to the housing-side coupling component, it is first inserted with the lugs 11 into the abutments described above. It is then pivoted about the lugs 11 on to the housing so that the snap-in catches 8 snap into the snap-in catch receivers described above. In this position the elastic seal 18 between the sound-tube-side coupling component 4 and the housing-side coupling component is compressed. In this case it is disposed so that it rests on the housing-side sealing surface and the sound channel 17 is then aligned with the housing-side sound channel 20.

Once the snap-in locking device formed by the snap-in catches 8 has snapped in, the holes 5 are located such that they overlap with the housing-side hole described above, or the holes are aligned.

Figure 4:
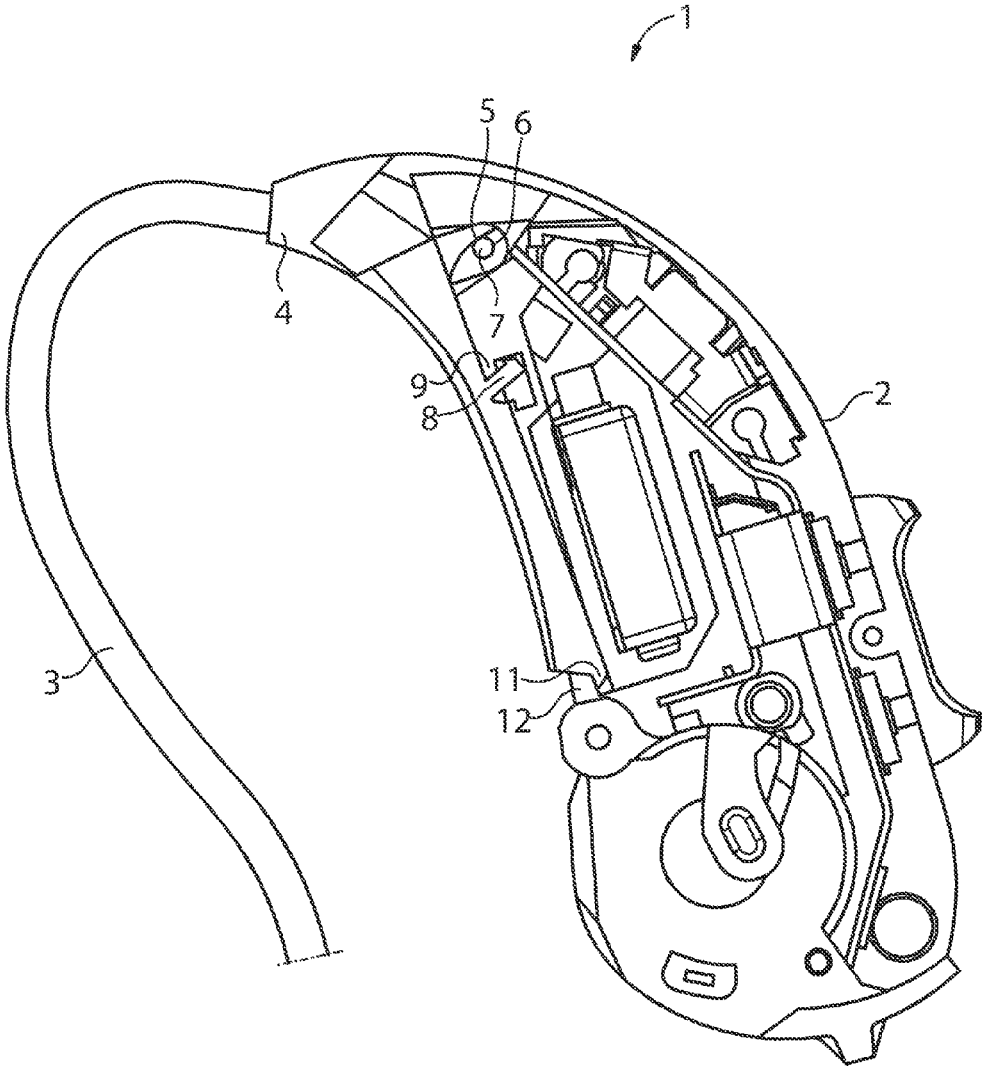
FIG. 4 is a side view of the BTE hearing instrument without the housing.

FIG. 4 shows a schematic view of the BTE hearing instrument 1. The housing 2 contains the hearing instrument components described above, with reference to which please see the above description of the figures. The sound tube 3 is connected to the housing 2 by way of the coupling. Accordingly the sound-tube-side coupling component 4 is mounted on to the housing 2 or rather the housing-side coupling component. In this closed state of the coupling, the lugs 11 are mutually engaged in a form-fit manner with the abutments 12. The snap-in catches 8 are snapped into the snap-in catch receivers 9. The holes 5 overlap with the housing-side hole 6, or they are aligned. A locking pin 7 is inserted through the holes 5, 6. So that the locking pin 7 can be inserted, the seal 18 disposed between the coupling components (not shown in the figure) must be compressed. The seal consequently exerts a force between the coupling components that is directed against the closing direction. The locking pin 7 counteracts the elastic force and thereby keeps the elastic seal 18 compressed. In this way the elastic force acts on the locking pin 7, which is consequently subjected to a radial load. More specifically a tensile force (directed down and to the left in the figure) is applied to the locking pin through the holes 5 as a result of the elastic force. By the tensile force a shearing force acts between the holes 5 and the housing-side hole 6 on the locking pin 7 and impedes or hampers an undesired movement thereof in an axial direction. The locking pin 7 is thereby fixed in its position by the elastic force of the seal 18.

From the explanation above it will be clear that the housing-side coupling component contains at least the hole 6, the sealing surface (not shown in the figure) around the sound channel, the snap-in catch receivers 9 and the abutments 12. While the sound-tube-side coupling component 4 is connected to the sound tube 3 as an autonomous component, the housing-side coupling component is integrated into the housing 2 and cannot be separated from the housing as an independent component.

The invention claimed is:

1. A behind-the-ear (BTE) hearing instrument, comprising:

a housing;

a coupling having a lug, an abutment corresponding to said lug and a locking device;

a sound tube removably connected to said housing by means of said coupling connected to said sound tube in a sound-insulated manner;

said coupling further having a sound-tube-side coupling component with a sound channel leading to said sound tube;

a receiver;

an acoustic seal;

said coupling additionally having a housing-side coupling component having a sound channel leading to said receiver, when said coupling is closed, said sound channel of said sound-tube-side coupling component and said sound channel of said housing-side coupling component are connected to each other in an insulated manner by said acoustic seal;

said lug and said abutment connecting said sound-tube-side coupling component to said housing-side coupling component in a form-fit manner and movable in at least one spatial direction relative to each other;

said locking device, when said coupling being closed, impedes a movement of said coupling components relative to each other in the at least one spatial direction; and said lug and said abutment and said locking device are disposed spatially separated from each other in said coupling.

2. The BTE hearing instrument according to claim 1, wherein said acoustic seal contains an elastic component that, when said coupling is closed, is compressed so that said acoustic seal causes an elastic force in an opening direction of said coupling components relative to each other, and said locking device counteracts the elastic force such that an opening of said coupling is impeded.

3. The BTE hearing instrument according to claim 1, wherein said coupling contains an additional snap-in locking device that snaps in when said coupling is closed.

4. The BTE hearing instrument according to claim 3, wherein said additional snap-in locking device is disposed spatially closer in said coupling to said locking device than to said lug and said abutment.

5. The BTE hearing instrument according to claim 1, wherein said locking device has a hole formed therein and a corresponding locking pin.

6. A sound tube for a behind-the-ear (BTE) hearing instrument, comprising:

a coupling connecting the sound tube to a housing of the BTE hearing instrument in a sound-insulated manner and in a removable manner, said coupling having a lug, an abutment corresponding to said lug and a locking device, said coupling having a sound-tube-side coupling component with a sound channel; and said lug and said abutment can connect said sound-tube-side coupling component to a housing-side coupling component in a form-fit and movable, in at least one spatial direction relative to each other, manner, and said locking device when said coupling is closed, impedes a movement of said coupling components relative to each other in the at least one spatial direction, and said lug and said abutment and said locking device are disposed spatially separated from each other in said coupling.

7. A housing for a behind-the-ear (BTE) hearing instrument, comprising:

a coupling for removably connecting the housing to a sound tube, said coupling connecting to the sound tube in a sound-insulated manner, said coupling having a lug, an abutment corresponding to said lug and a locking device, said coupling having a housing-side coupling component with a sound channel leading to a receiver, said lug including said abutment can connect a sound-tube-side coupling component to said housing-side coupling component in a form-fit and movable, in at least one spatial direction relative to each other, manner, said locking device when said coupling is closed, impedes a movement of said coupling components relative to each other in the at least one spatial direction, and said lug including said abutment and said locking device are disposed spatially separated from each other in said coupling.

* * * * *